US005506819A

United States Patent [19]

Chen

[11] Patent Number: 5,506,819

[45] Date of Patent: Apr. 9, 1996

[54] ORNAMENTAL CLOCK WITH SOUND-PRODUCING MEANS

[76] Inventor: Fu-Tien Chen, 3F, No. 10, Lane 195, Chi Yuan Road, Taipei, Taiwan

[21] Appl. No.: 396,552

[22] Filed: Mar. 1, 1995

[51] Int. Cl.[6] ..... G04B 21/02; G04B 19/00; G04C 23/00

[52] U.S. Cl. ..... 368/75; 368/273; 368/278

[58] Field of Search ..... 368/10, 12, 45, 368/63, 72–75, 243, 244, 250, 272–274, 276, 278, 285, 316–317

[56] References Cited

U.S. PATENT DOCUMENTS

| | | | |
|---|---|---|---|
| 5,226,021 | 7/1993 | Dell'olio | 368/12 |
| 5,258,963 | 11/1993 | Yao | 368/10 |
| 5,311,488 | 5/1994 | Trantham | 368/250 |

*Primary Examiner*—Vit W. Miska

*Attorney, Agent, or Firm*—Thomas R. Vigil

[57] ABSTRACT

An ornamental clock capable of producing motion and sounds including a vehicle frame having a base installed at its bottom. A clock slot is provided at an appropriate position of the vehicle frame for receiving a clock actuated by a clock movement. The ornamental clock is characterized in that a power transmission mechanism, a power source means, a speaker, a reset button and a circuit board are installed at appropriate positions within the vehicle frame. The power transmission mechanism, power source device, speaker and reset button are connected together with the circuit board via an electrical circuit board. The circuit board is also connected to the clock movement by an electrical wire. Through the control of the circuit board in conjunction with the setting of the reset button, at each hour, the power transmission mechanism drives wheels on the outer side of the vehicle frame to rotate during a specific period of time. In addition, the speaker can tell the time of the clock or produce sound effects during a specific period of time through the control of the circuit board.

5 Claims, 3 Drawing Sheets

ORNAMENTAL CLOCK WITH SOUND-PRODUCING MEANS

BACKGROUND OF THE INVENTION

The present invention relates to ornamental clocks, and more particularly to an ornamental clock capable of producing sounds and motion.

Existing ornamental clocks are mostly static. The clock is simply located in a frame which is in the form of a car so as to achieve the dual purposes of indicating the time and providing ornamentation. Such ornamental clocks are quite popular, but because their design is not very special, they are likely to be put aside or discarded after a period of use.

SUMMARY OF THE INVENTION

A primary object of the present invention is to provide an ornamental clock fitted in a vehicle frame such as the locomotive, and which is equipped with moving wheels and sound-producing means, wherein by means of a power transmission mechanism, an electrical circuit board, a power source means, a speaker, a reset button and a clock movement which are inter-connected by electrical wire loops and disposed at suitable positions within a vehicle frame. When the clock movement reaches an hour sharp, a signal is transmitted to the circuit board; by means of the circuit board which has predetermined functions, the power transmission mechanism and the speaker are actuated, so that the ornamental clock has the dual functions of rotating the wheels of the locomotive and producing sounds.

Another object of the present invention is to provide a locomotive-designed ornamental clock which is capable of motion and producing sounds, wherein by means of a power transmission mechanism, an electrical circuit board, a power source means, a speaker, a signal light, a reset button and a clock movement which are connected by electrical wire loops and disposed at suitable positions within a vehicle frame. When the clock movement reaches an hour sharp, a signal is transmitted to the circuit board; by means of the circuit board which has predetermined functions, the power transmission mechanism, the speaker and the signal light are actuated, so that the ornamental clock has the triple functions of producing motion, sounds and flashing light.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
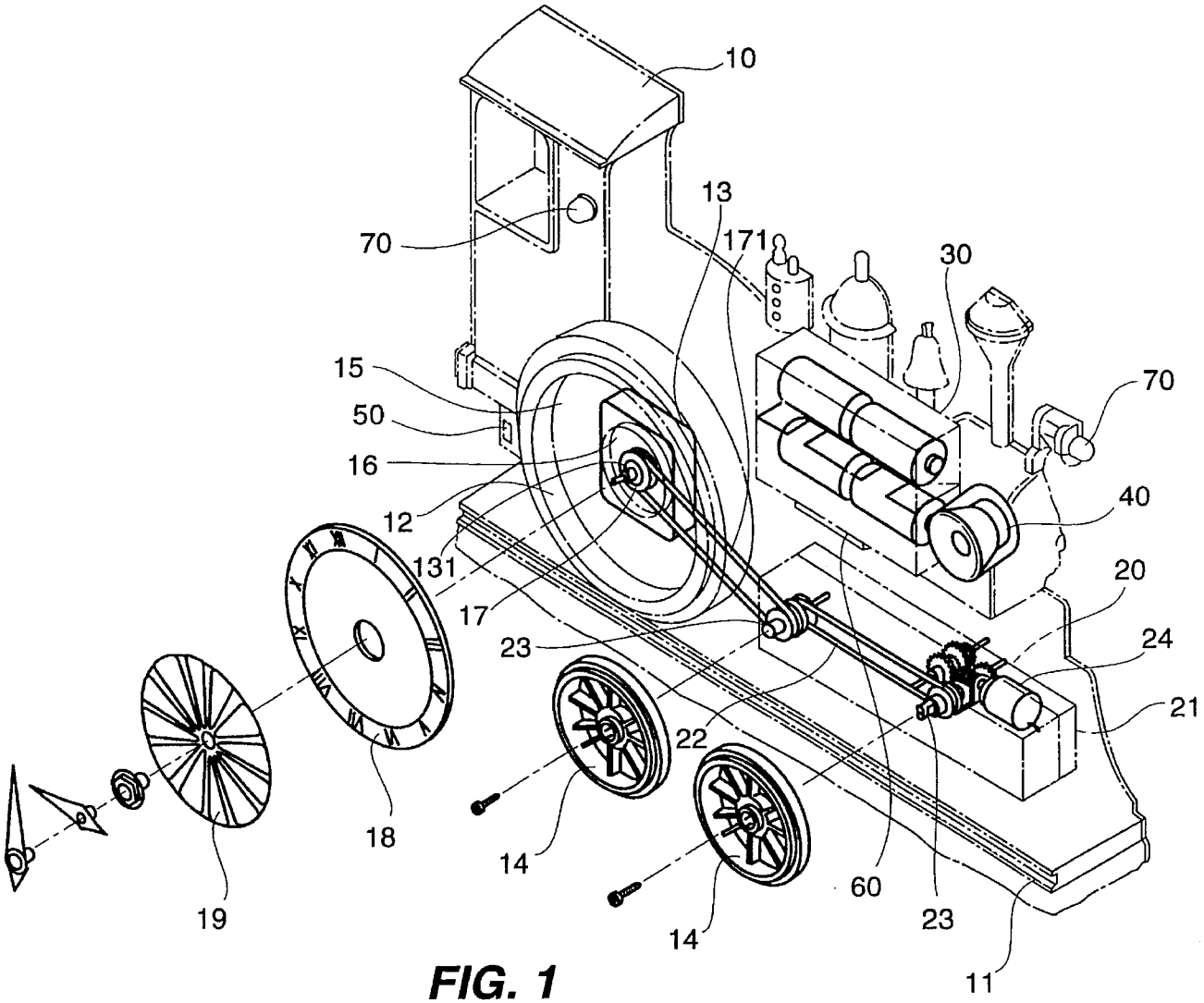
FIG. 1 is a perspective exploded view of a dimensional structure of the locomotive-designed ornamental clock of the present invention.
Figure 2:
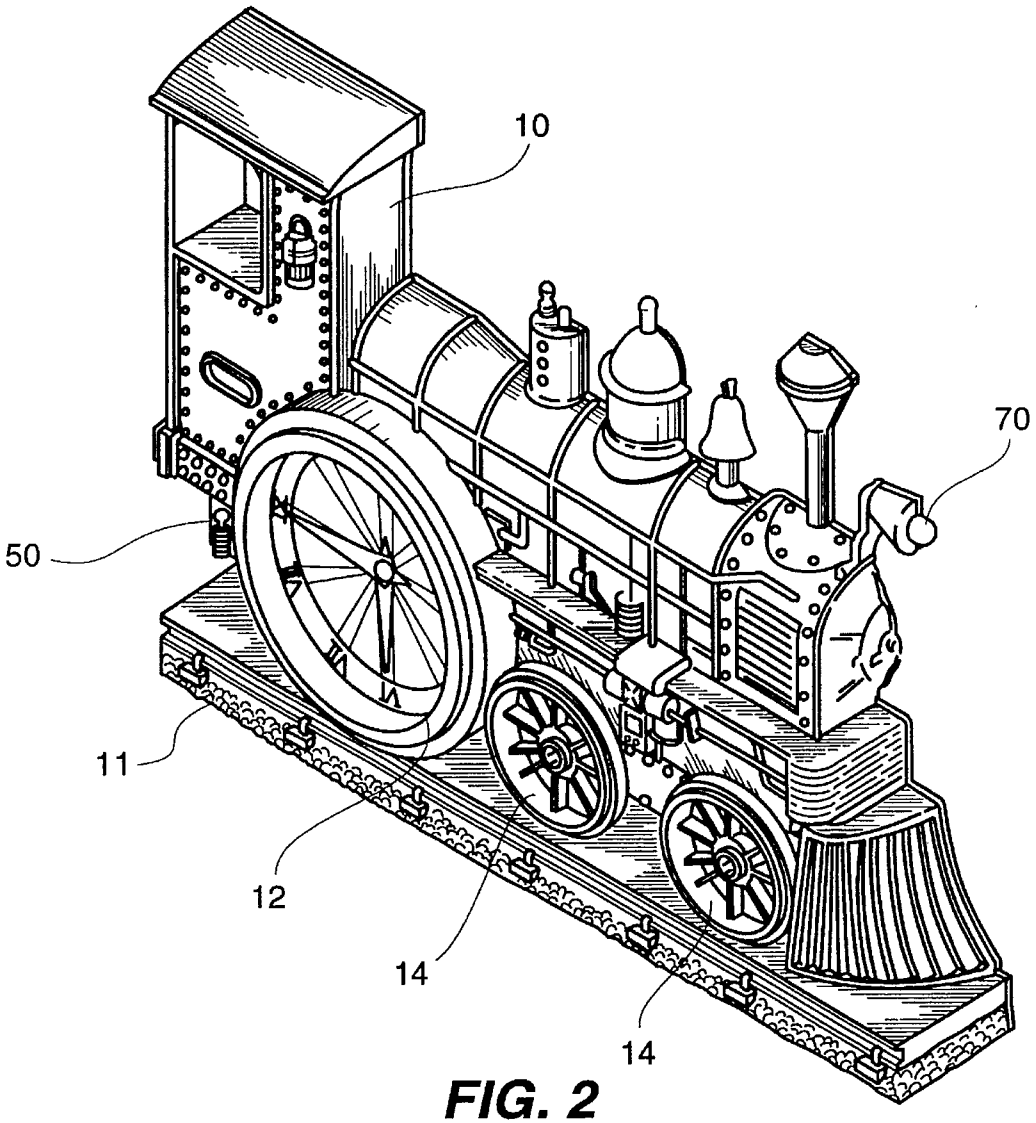
FIG. 2 is an outer view of the dimensional structure of the locomotive-designed ornamental clock of the present invention.
Figure 3:
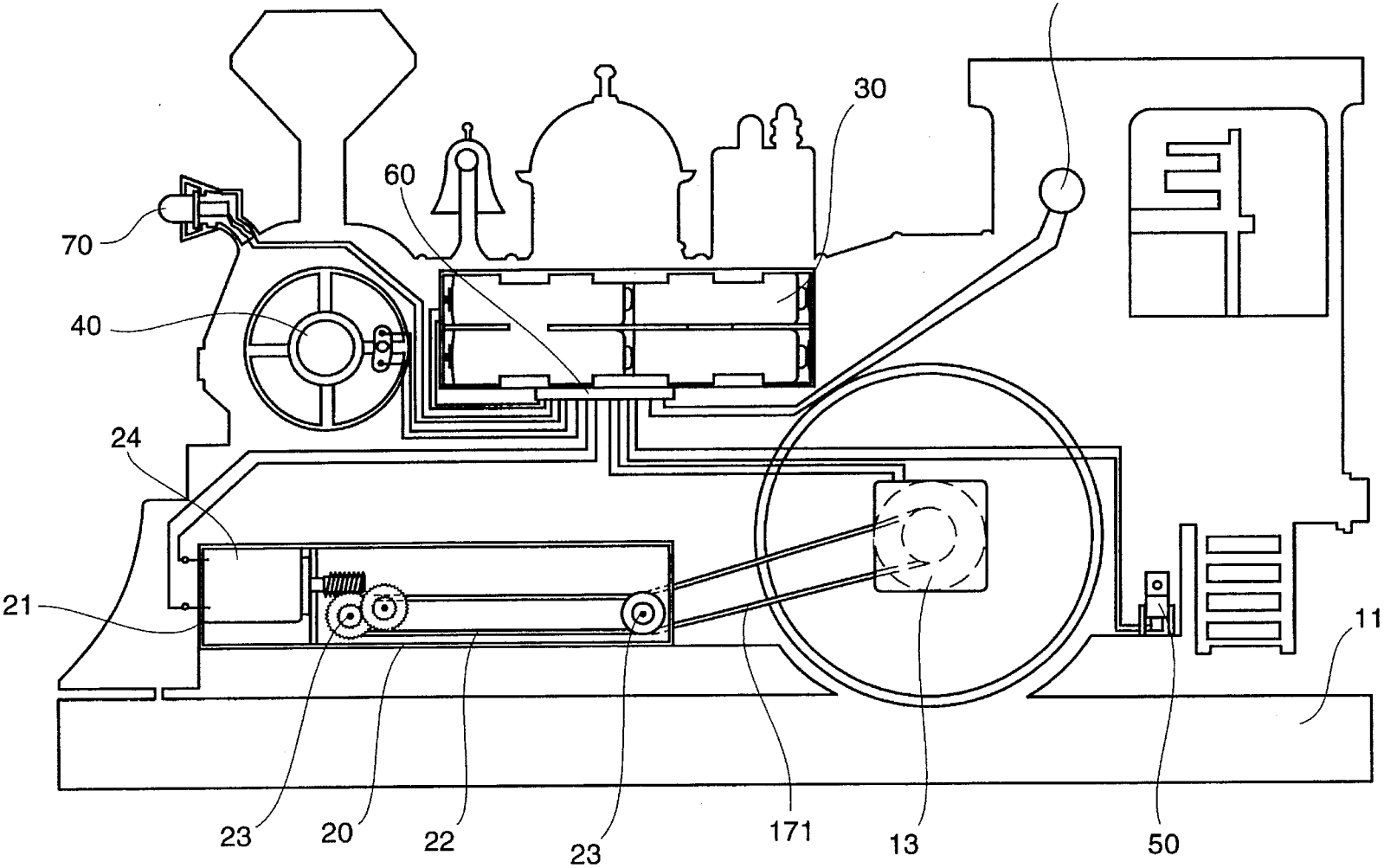
FIG. 3 is a schematic view of a plan structure of the locomotive-designed ornamental clock of the present invention.

With reference to the drawings, the ornamental clock of the present invention mainly comprises a vehicle frame 10, wherein the vehicle frame 10 is provided with a base 11 at its bottom side, and the vehicle frame 10 is placed on the base 11. A clock slot 12 is provided at a suitable position of a front side of the vehicle frame 10, and a clock driven by a clock movement 13 is disposed in the clock slot 12.

In addition to a power transmission mechanism 20, a power source means 30, a speaker 40 and a reset button 50, which are disposed at suitable positions within the vehicle frame 10, an electrical circuit board 60 is also provided at a suitable position therein. The electrical circuit board 60 is connected by electrical wire loops to the power transmission mechanism 20, the power source means 30, the speaker 40 and reset button 50. The electrical circuit board 60 may also be connected to the clock movement 13 by means of an electrical wire.

The power transmission mechanism 20 comprises a frame 21, which has a multiplicity of transmission shafts 23 inter-linked together by means of transmission belts 22. A motor 24 is disposed at one side near one of the transmission shafts 23. One end of each transmission shaft 23 penetrates the vehicle frame 10 to connect integrally with corresponding wheels provided on the outside of the vehicle frame 10. The electrical circuit board 60 is connected by an electrical wire to the motor 24 of the power transmission mechanism 20.

At each hour of the clock, the clock movement 13 will transmit a signal to the electrical circuit board 60 which has predetermined functions, and the electrical circuit board 60 will generate a signal to drive the motor 24 of the power transmission mechanism 20 to rotate, so as to cause the wheels 14 which are connected to the transmission shafts 23 of the power transmission mechanism 20 and are provided on the outside of the vehicle frame 10 to rotate for a predetermined period. The electrical circuit board 60 will also generate a signal to the speaker 40 to tell the time or to produce certain sound effects matching the design of the clock for a predetermined period.

A slot 16 is also provided at a suitable position of the center of a rear wall 15 of the clock slot 12. A shaft sleeve 131 of the clock movement 13 is fixed at the center of a rear wall of the slot 16, and is fitted with a belt pulley 17. An outer end of the belt pulley 17 is designed to extend from a central hole of a face-plate 18 of the clock so that a rotary element 19 may be fixedly provided at the outer end of the belt pulley 17. The belt pulley 17 may further be connected to one of the transmission shafts 23 provided at the power transmission mechanism 20 by means of a belts 171, so that when the power transmission mechanism 20 rotates the wheels 14, the rotary element 19 is also caused to rotate simultaneously.

A suitable signal light 70 may also be provided at a suitable position of the vehicle frame 10. The signal light 70 is connected to the electrical circuit board 60 by an electrical wire, so that at each hour of the clock, a signal is generated to cause the signal light 70 to flash.

To prevent disturbing people's sleep, the electrical circuit board 60 of the ornamental clock may be designed to stop transmitting signals during a specific period, such as 10 p.m. to 6 am, so that the clock will stop producing sound effects during that period of time.

The major function of the reset button 50 is to adjust the time-telling function so as to match the exact time of the clock. Except for the specific period in which the electrical circuit board 60 does not transmit any signals, the electrical circuit board 60 will transmit signals to tell the time of the clock at each hour sharp of the clock; therefore, if the clock is too slow or has stopped moving due to certain causes so that the time-telling function does not match the exact time of the clock, the user may press the reset button 50 to adjust the time-telling signal output to match the exact time of the clock.

In view of the aforesaid, the ornamental clock of the present invention not only has the functions of conventional ornamental clocks; but by means of the circuit board, power source means, speakers and power transmission mechanism, it also has the functions of moving and producing sounds. A signal light may also be added to produce visual effects.

Although the present invention has been illustrated and described with reference to the preferred embodiment thereof, it should be understood that it is in no way limited to the details of such embodiment but is capable of numerous modifications within the scope of the appended claims.

What is claimed is:

1. An ornamental clock with sound-producing means, said ornamental clock comprising:

a vehicle frame provided with a base at a bottom side thereof for said vehicle frame to be mounted thereon, said vehicle frame having a clock slot disposed at a suitable position of a front side thereof for receiving a clock driven by a clock movement, an interior of said vehicle frame accommodating therein a power transmission mechanism, a power source means, a speaker, a reset button, and an electrical circuit board, wherein said electrical circuit board is respectively connected by electrical wire loops to said power transmission mechanism, said power source means, said speaker and said reset button as a whole, said electrical circuit is also connected to said clock movement by an electrical wire, so that, at each hour of the clock, said electrical circuit board, in cooperation with said reset button, drives said power transmission mechanism to cause wheels which are provided at the outside of said vehicle frame and connected to said power transmission mechanism to rotate during a specific period, and said electrical circuit board also controls said speaker to produce certain sound effects or tell the time of the clock.

2. An ornamental clock as claimed in claim 1, wherein said power transmission mechanism is provided with a multiplicity of rotary shafts and a motor for simultaneously driving said rotary shaft, said rotary shafts penetrating through said vehicle frame and connected to said wheels provided on the outside of said vehicle frame.

3. An ornamental clock as claimed in claim 1, wherein said power transmission mechanism drives a rotary shaft provided in said clock slot, an end portion of said rotary shaft projecting on a faceplate of said clock being fixedly provided with a rotary element, so that when said power transmission mechanism drives said wheels to rotate, said rotary element is also caused to rotate.

4. An ornamental clock as claimed in claim 1, wherein a signal light is provided at a suitable position of said vehicle frame, said signal light being connected to said electrical circuit board by an electrical wire for producing flashing effects at each hour of the clock.

5. An ornamental clock as claimed in claim 1, wherein said electrical circuit board is designed to stop transmitting any signals during a specific period of time.

* * * * *